US005632202A

United States Patent [19]

Robesin et al.

[11] Patent Number: 5,632,202

[45] Date of Patent: May 27, 1997

[54] DEVICE FOR PLACING A CYLINDRICAL SCREEN IN, AND REMOVING IT FROM, A ROTARY SCREEN PRINTING MACHINE

[75] Inventors: Bernardus A. Robesin, Vierlingsbeek; Henricus P. J. M. van den Hurk, Veghel, both of Netherlands

[73] Assignee: Stork X-Cel B.V., Boxmeer, Netherlands

[21] Appl. No.: 453,922

[22] Filed: May 30, 1995

[30] Foreign Application Priority Data

May 30, 1994 [EP] European Pat. Off. ..... 94201527

[51] Int. Cl.[6] ..... B41F 5/00

[52] U.S. Cl. ..... 101/216; 101/212

[58] Field of Search ..... 101/216, 212, 101/153, 116, 115; 248/107, 153, 311.2; 414/427, 448, 785, 911, 910

[56] References Cited

U.S. PATENT DOCUMENTS 3,834,307 9/1974 Zimmer ..... 101/115

FOREIGN PATENT DOCUMENTS

0533053A1 10/1992 European Pat. Off. .

7231578 3/1973 France .

*Primary Examiner*—Edgar S. Burr

*Assistant Examiner*—Anthony H. Nguyen

*Attorney, Agent, or Firm*—Brooks & Kushman P.C.

[57] ABSTRACT

A device for placing a cylindrical screen provided with end rings in, and removing it from, a rotary screen printing machine comprises a screen support and lifting means connected to the screen support, for moving the screen support up and down. The screen support is designed to support the cylindrical screen while it is moving up and down. The screen support is provided with guide means, for example guide bars, along which the cylindrical screen can be moved in its lengthwise direction. With the aid of the device, cylindrical screens can be placed in, and removed from, the screen printing machine in a simple way, with the minimum chance of damage to the screens.

5 Claims, 3 Drawing Sheets

DEVICE FOR PLACING A CYLINDRICAL SCREEN IN, AND REMOVING IT FROM, A ROTARY SCREEN PRINTING MACHINE

BACKGROUND OF THE INVENTION

The present invention relates to a device for placing a cylindrical screen provided with end rings in, and removing it from, a rotary screen printing machine.

Cylindrical screens of a rotary screen printing machine are currently placed in the machine and removed from it by hand. In the case of narrow machines one person can generally do this. However, relatively uncomfortable positions have to be adopted for this purpose, since the person concerned has to reach across the machine in order to take hold of the screen with his hands at both ends. Moreover, the chance of damaging the screen in this situation is relatively great. For broader machines, in which longer screens are used, the assistance of a second person is needed.

SUMMARY OF THE INVENTION

The object of the invention is to provide a device for placing a cylindrical screen in, and removing it from, a rotary screen printing machine, by means of which device the abovementioned disadvantages are overcome.

This object is achieved by a device for placing a cylindrical screen provided with end rings in, and removing it from, a rotary screen printing machine, comprising a screen support and lifting means connected to the screen support, for moving the screen support up and down, the screen support being designed to support the cylindrical screen while it is moving up and down, and the screen support being provided with guide means along which the cylindrical screen can be moved in its lengthwise direction.

With this device, a cylindrical screen with end rings which has been detached from the end supports supporting the end rings can be lifted up in a simple manner with the screen support, while the screen is resting on the guide means, and the screen can then be moved along the guide means in the crosswise direction of the rotary screen printing machine. The cylindrical screen can then simply be picked up and taken away. The placing of the screen is carried out in the reverse order. Longer screens can also be installed and removed in a very simple way with the device according to the invention, while the risk of damage to the screen is minimized.

Preferred embodiments of the device according to the invention are defined in the sub-claims.

DESCRIPTION OF THE PREFERRED EMBODIMENT

Figure 1:
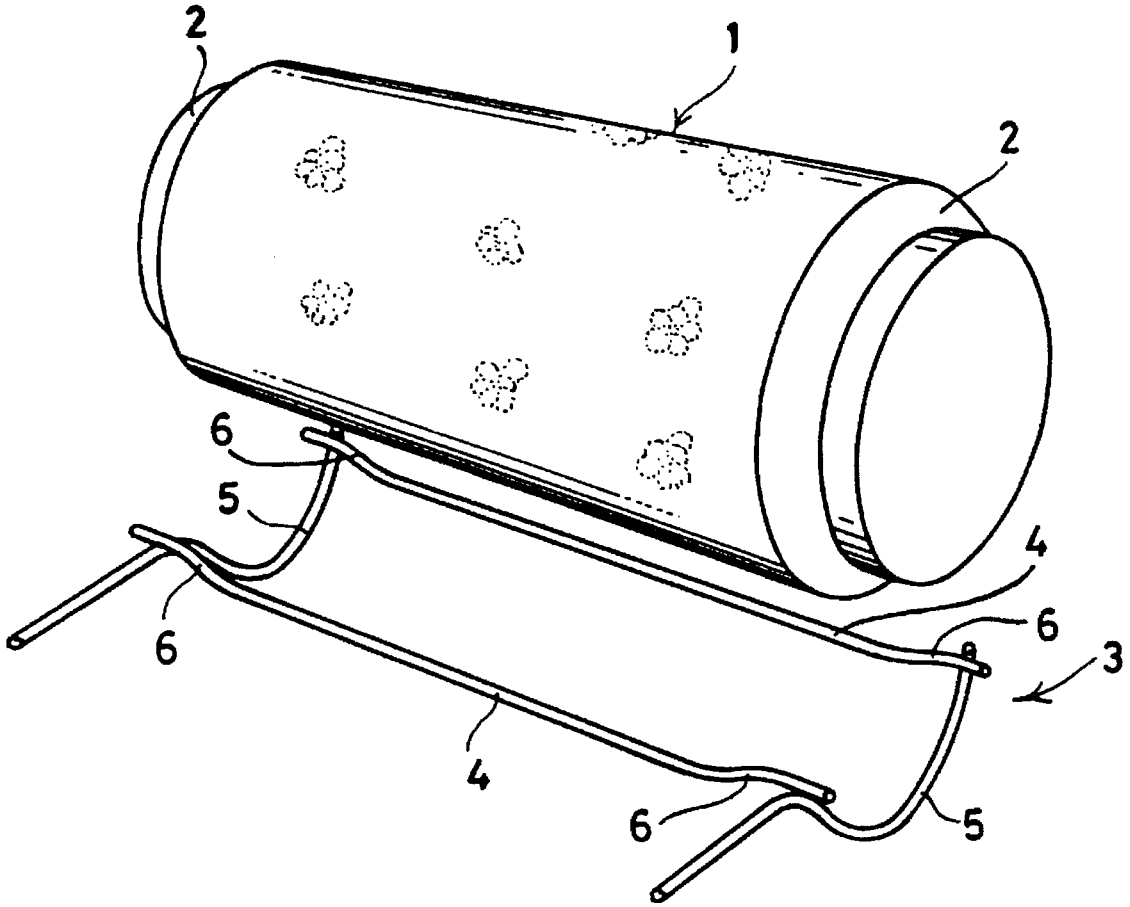
FIG. 1 shows diagrammatically and in perspective a cylindrical screen with end rings and its screen support.

FIG. 1 shows diagrammatically a cylindrical screen 1 which is provided with end rings 2. Shown below the screen

1 is a screen support 3 which forms part of a device for installing the screen 1 provided with end rings 2 in, and removing it from, a rotary screen printing machine. The screen support 3 consists of two guide bars 4 extending essentially horizontally and parallel to each other. The length of the guide bars is essentially equal to, and in practice slightly greater than, the length of the cylindrical screen 1 with end rings 2. The distance between the guide bars 4 is smaller than the diameter of the cylindrical screen 1, so that the screen 1 with end rings can rest upon the guide bars 4.

The guide bars 4 are connected to each other at the ends by transverse bars 5 which are preferably curved downwards with a radius of curvature which is smaller than the radius of the cylindrical screen 1.

The guide bars 4 are curved upwards near the ends, in the region where the end rings 2 of the cylindrical screen 1 come to rest on the guide bars when the screen 1 is resting on the screen support 3. This means that in the situation in which the screen 1 with end rings 2 is being supported by the screen support 3 the end rings 2 rest upon the upward curved end parts 6 of the guide bars 4, and the actual screen part lies clear of the guide bars 4.

The screen support 3 can be moved up and down by lifting means to be described in greater detail below.

Figure 2:
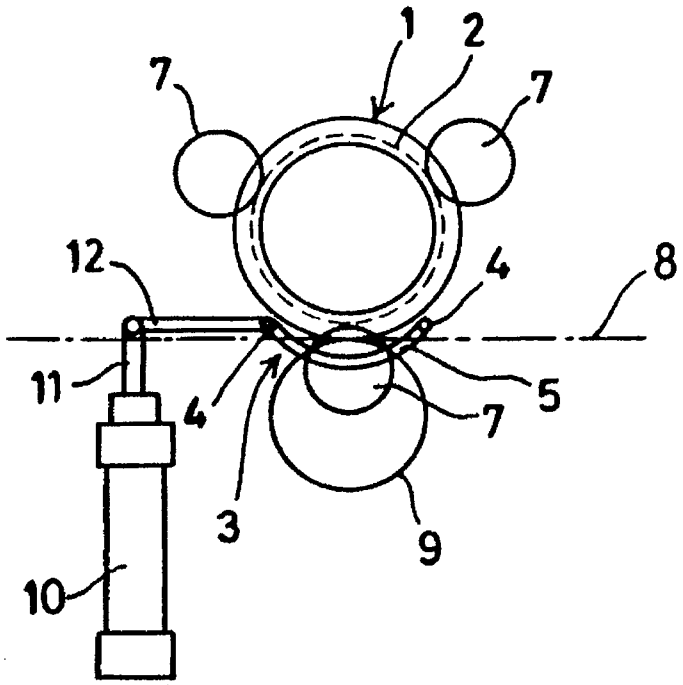
FIG. 2 shows a very diagrammatic side view of a part of a rotary screen printing machine with cylindrical screen and device according to the invention, in which the cylindrical screen is in the operating position.

FIG. 2 shows the situation in which a cylindrical screen 1 with the end rings 2 is accommodated in end supports which are disposed on a rotary screen printing machine, and which in this case consist of three rollers 7 interacting with the end rings. These rollers can be moved apart in order to release the cylindrical screen 1.

FIG. 2 also shows diagrammatically a material web 8 to be printed and a counterpressure roller 9. The screen support 3 is also shown in FIG. 2. The screen support 3 lies below the cylindrical screen. The guide bars 4 lie between the cylindrical screen and the material web 8. The transverse bars 5 are situated next to the material web.

Figure 3:
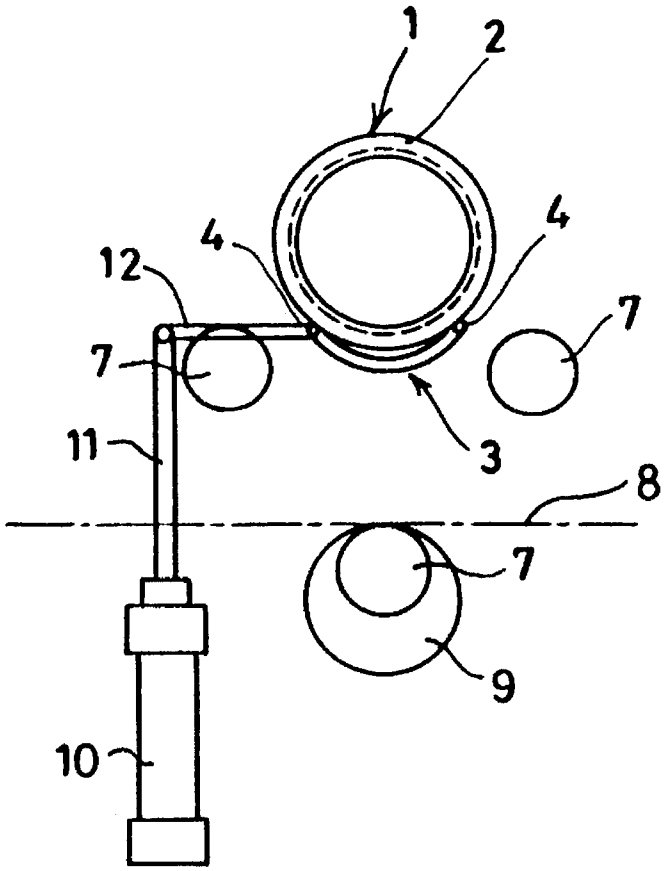
FIG. 3 is a view corresponding to FIG. 2, in which the screen has been removed from the rotary screen printing machine by the device according to the invention.

FIG. 3 shows the situation in which the cylindrical screen 1 has been removed from the rotary screen printing machine and is resting upon the screen support 3. Before the cylindrical screen 1 has been removed, the rollers 7, which interact with the end rings 2, are moved apart.

The lifting means preferably consist of two vertical lifting cylinders 10 disposed near the ends of the screen support, as shown in FIGS. 2 and 3. The piston rods 11 of the cylinders 10 are connected by means of transverse arms 12 to the screen support 3, preferably to the transverse bars 5.

The invention is not limited to the embodiment of the device according to the invention described above.

Other lifting means can also be used instead of lifting cylinders 10.

The screen support can also be designed differently. A number of possible other embodiments are shown very diagrammatically in FIGS. 4 to 7.

Figure 4:
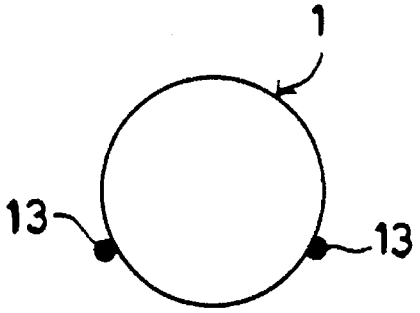
FIGS. 4 to 7 show very diagrammatically a number of differently designed screen supports.

In FIG. 4 the screen support consists only of guide bars 13 which are not directly connected to each other. The ends of said guide bars can each be connected individually to a lifting means (not shown).

Figure 5:
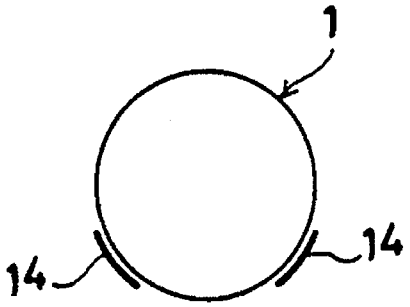

As shown in FIG. 5, channel-shaped guides 14 can also be used instead of guide bars, which channel-shaped guides are connected to each other, as in the embodiment of FIGS. 1 to 3, or which are each individually connected to lifting means, as in the embodiment of FIG. 4.

Figure 6:
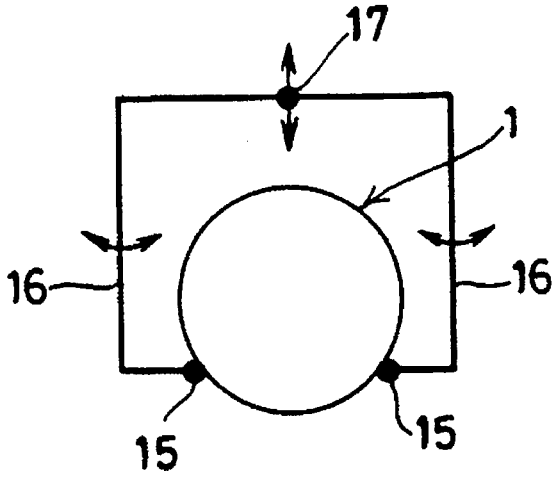

In FIG. 6 the screen support consists of guide bars 15 which are connected to arms 16, which in turn are hingedly connected to each other at the position of hinge point 17. The screen support can grip like tongs around the screen 1. The lifting means can be connected to the screen support at the position of the hinge point 17. This embodiment has the advantage that the screen support is easy to remove, and the guide bars 15 need not be present permanently between the cylindrical screen 1 and the material web (not shown).

Figure 7:
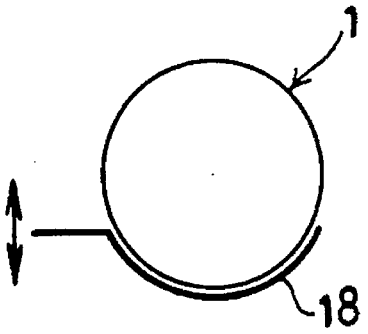

In FIG. 7 the screen support consists of a channel 18 which can be moved up and down by means of lifting means. Said channel 18 cannot, of course, be present permanently below the cylindrical screen 1. For removal of the screen 1 from the rotary screen printing machine, the screen 1 first has to be lifted up over a certain distance so that the channel 18 can be placed below the screen 1. Second lifting means (not shown) are needed for this.

What is claimed is:

1. A device for placing a cylindrical printing screen provided with end rings in, and removing it from, a rotary screen printing machine, comprising, in combination:

a screen support for engaging beneath a cylindrical printing screen in a rotary screen printing machine;

lifting mechanism connected to the screen support and operable to raise and lower it for raising and lowering a cylindrical printing screen beneath which the support is disposed;

said screen support having screen supporting guides upon which the cylindrical printing screen rests and along which the screen is moveable in its lengthwise direction; and said supporting guides comprising a pair of parallel guide members extending generally horizontally and of a length generally coextensive with the cylindrical screen with end rings, and said pair of guide members disposed spaced apart a distance less than the diameter of the cylindrical screen.

2. The invention defined by claim 1 wherein the guide members have raised end portions for engaging the end rings of the cylindrical screen to support the printing surface thereof out of engagement with the bars.

3. The invention defined by claim 1 wherein said lifting mechanism comprises lifting cylinders disposed at opposite ends of the screen support and operably connected thereto for raising and lowering the support.

4. The invention defined by claim 1 wherein said guide members are connected together by transverse arms and the lifting cylinders are operably connected to such arms.

5. The invention defined by claim 1 wherein said lifting mechanism is operable to shift the screen support from a position remote from the cylindrical printing screen to a position beneath the screen and to raise and lower the screen when beneath it.

* * * * *